US005793710A

United States Patent [19]

Jacobi, Jr.

[11] Patent Number: 5,793,710

[45] Date of Patent: Aug. 11, 1998

[54] HOROLOGE WITH REMOVABLE AND INTERCHANGEABLE FACE

[75] Inventor: James J. Jacobi, Jr., Ft. Montgomery, N.Y.

[73] Assignee: North River Consulting, Inc., Ponte Vedra Beach, Fla.

[21] Appl. No.: 668,958

[22] Filed: Jun. 21, 1996

[51] Int. Cl.[6] ..... G04B 19/04

[52] U.S. Cl. ..... 368/223; 368/228

[58] Field of Search ..... 368/88, 223, 228, 368/232, 236, 294–296

[56] References Cited

U.S. PATENT DOCUMENTS

| | | | |
|---|---|---|---|
| 4,660,992 | 4/1987 | Paul et al. | 368/223 |
| 5,008,869 | 4/1991 | Rueck | 368/228 |
| 5,018,118 | 5/1991 | Ross | 368/228 |
| 5,224,028 | 6/1993 | Mallin | 368/223 |

*Primary Examiner*—Vit W. Miska

*Attorney, Agent, or Firm*—Paul J. Sutton

[57] ABSTRACT

A horologe, such as a watch or a clock, includes a body housing a horological mechanism and having a substantially flat outer surface, a stem extending in a perpendicular direction from the outer surface, at least one hand attached to the stem and extending in a direction parallel to the outer surface. A rim extends around the periphery of the body, wherein a portion of the rim is removable from the body. An outer transparent crystal and inner transparent cover is attached to the non-removable portion of the rim above the outer surface. The crystal is disposed above the hand and the cover is disposed below the hand and above the outer surface. A thin, substantially flat removable face is adapted for insertion in and removal from the space between the outer surface and the inner transparent cover below the hand. The face is made of flexible, resilient material having an aperture in the center of the face sufficient in size to permit the stem to extend therethrough and having a hairline cut extending radially from the aperture to the perimeter of the face. Two flexible, resilient tabs are attached to the two ends of the removable portion of the rim for engagement with and attachment to the non-removable portion of the rim.

28 Claims, 9 Drawing Sheets

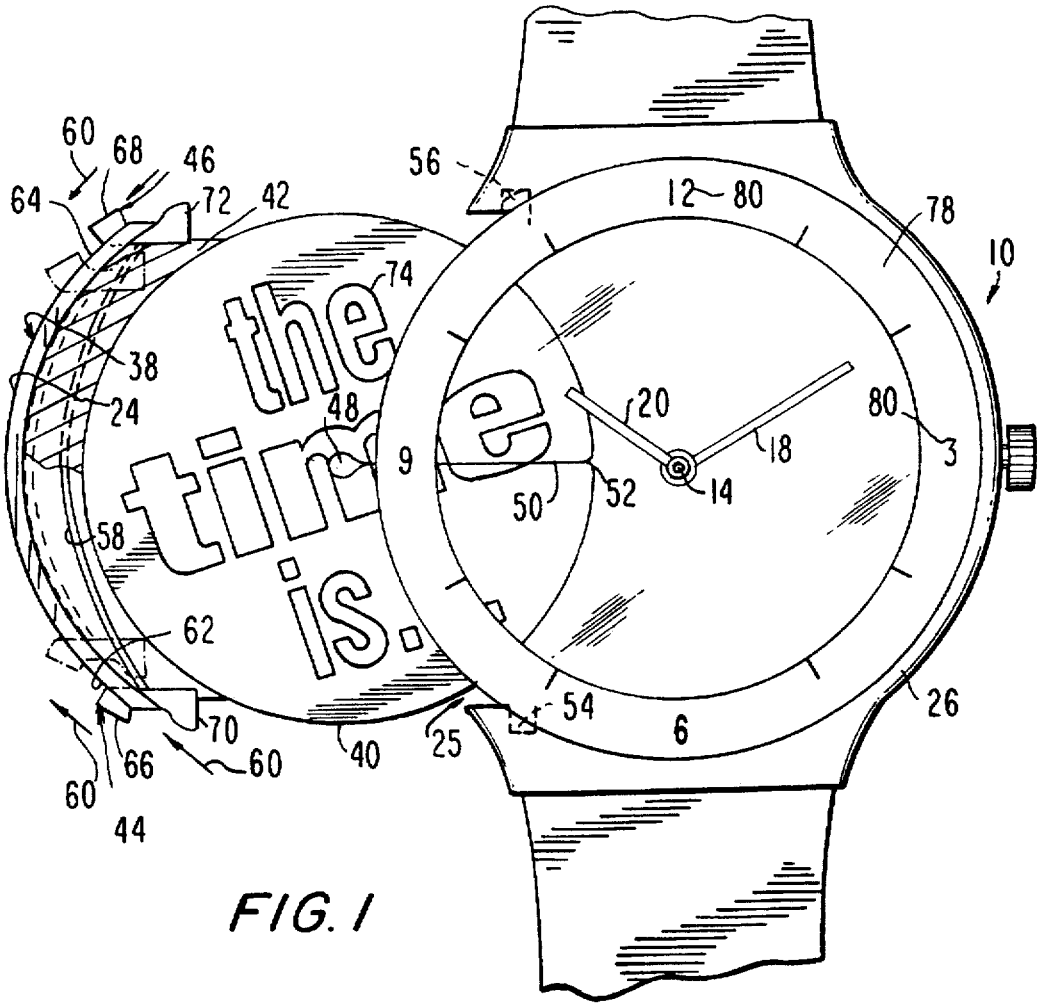
FIG. 1
FIG. 2
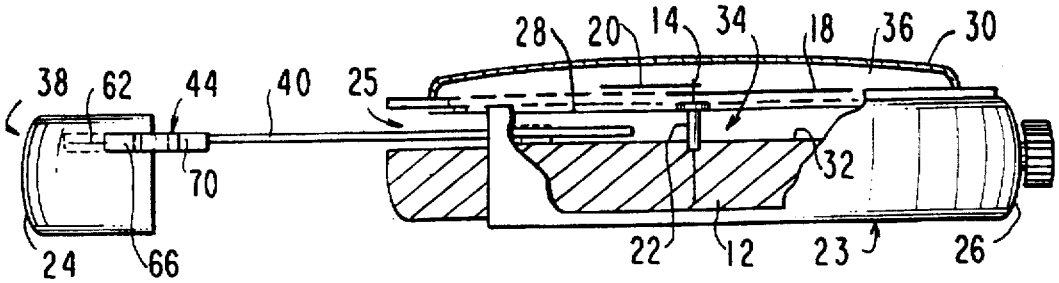

56
46
68
64
72
12
10
74
the
time
is...
38
24
9
3
14
50
62
44
70
6
26
60
66
54

34
18
62
44
28
40
20
14
30
36
10
78
38
24
66
70
22
32
12
23
26

FIG. 13A
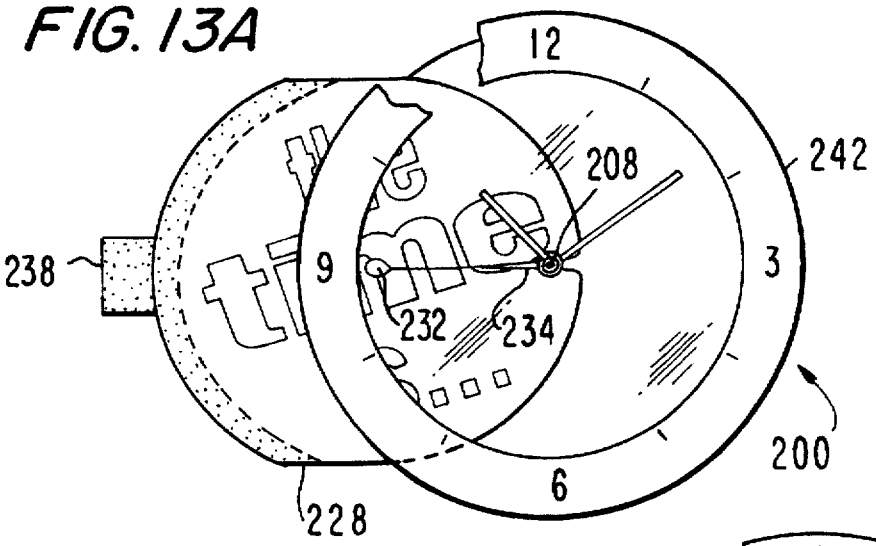
FIG. 13B
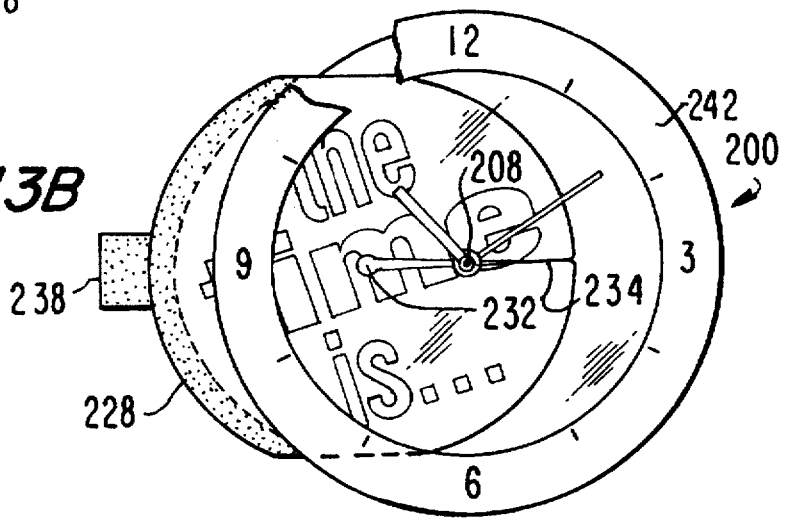
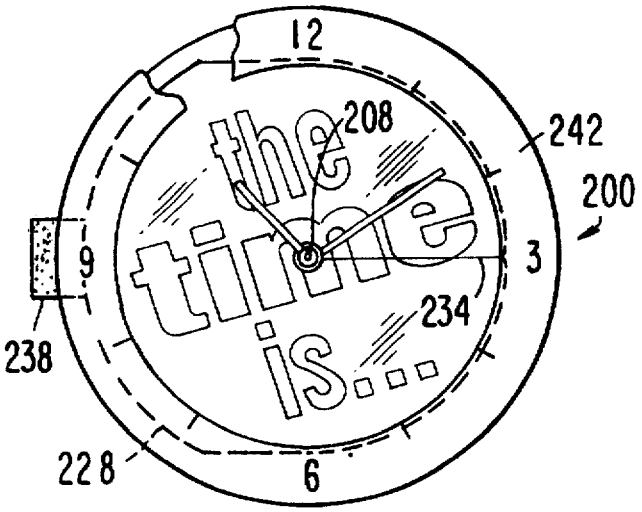
FIG. 13C

HOROLOGE WITH REMOVABLE AND INTERCHANGEABLE FACE

BACKGROUND OF THE INVENTION

1. Field of the Invention

This invention relates generally to a horologe, such as a watch or a clock, with a removable and interchangeable face.

2. Description of the Prior Art

A number of horologes have been developed with removable or movable faces. Such devices are disclosed, for example, in U.S. Pat. Nos. 619,078, 1,503,097, 2,132,051, 3,111,003, 3,465,512, 3,817,022, 4,034,555, 4,444,513, 4,525,077, 4,541,727, 4,660,992, 5,008,869, 5,018,118, 5,168,479 and 5,224,078. None of these patents, however, discloses watches or clocks with faces which are easy to remove and replace while maintaining the integrity and functionality of the timepiece.

SUMMARY OF THE INVENTION

In accordance with the present invention, a horologe, such as a watch or a clock, is disclosed in which the face can be easily removed and replaced without interfering with the function of the horologe. The single most distinctive visual element of any horologe or timepiece is its face. It is the face that gives the timepiece—whether it is a clock or watch—its character and personality. The face of a clock or watch sets the tone or the mood. At present, the norm is for a timepiece to have a single, permanent face. The only way to change the character or look of the timepiece is to replace the entire timepiece. The present invention creates an inexpensive and practical alternative with endless possibilities.

The horologe of the present invention comprises a body which comprises a horological mechanism and has a substantially flat outer surface. A shaft extends from the outer surface of the body in a perpendicular direction to the plane of the body. At least one hand is attached to the shaft extending therefrom in a direction parallel to the outer surface of the body. A rim extends around the periphery of the body. A portion of the rim is removable from the body. A transparent crystal and an inner transparent cover are attached to the non-removable portion of the rim above the outer surface of the body.

The horologe further comprises a thin, substantially flat, removable face which is adapted for insertion in and removal from the space between the outer surface of the body and the inner transparent cover below the hand. The face is made of a flexible, resilient material. There is an aperture in the center of the face of a size sufficient to permit the shaft to extend therethrough, and a hairline cut extending radially from the aperture to the perimeter of the face. The horologe further comprises a removable rim assembly comprising the removable portion of the rim, a means for attaching the removable face thereto, and two flexible, resilient tabs attached to the two ends of the removable portion of the rim for engagement with and attachment to the non-removable portion of the rim.

The various objects of the invention are basically attained by providing a horologe comprising: a body enclosing a horological mechanism and having a substantially flat outer surface; a shaft extending in a perpendicular direction from the outer surface and being operatively connected to the horological mechanism; at least one hand attached to the shaft and extending in a direction parallel to the outer surface; a rim extending around the periphery of the body, the rim having a removable rim assembly and a non-removable rim portion; an inner transparent cover and an outer transparent crystal attached to the non-removable rim portion above the outer surface and defining an enclosed space, the crystal being disposed above the hand and the inner cover being disposed below the hand, the inner cover being spaced from the outer surface of the body to define a faceplate compartment; a thin, substantially flat removable face removably received in the faceplate compartment, wherein the face is made of flexible, resilient material having a central aperture of sufficient size to permit the shaft to extend therethrough, and having a hairline cut extending radially from the central aperture to a perimeter of the face; the removable rim assembly comprising the face attached thereto, and two flexible, resilient tabs coupled to opposite ends of the removable rim assembly for engagement with and attaching to the non-removable rim portion.

The objects of the invention are further attained by providing a horologe comprising: a body enclosing a horological mechanism and having a substantially flat outer surface; an outer transparent crystal attached to the body and being spaced from the outer surface for defining a faceplate compartment; the body including a rim portion having an opening for accessing the faceplate compartment, the body having a pair of recesses adjacent the opening; a removable rim assembly having a pair of coupling tabs at opposite ends thereof for coupling with the recesses of the body and substantially closing the opening; a removable face attached to the removable rim assembly and being dimensioned to be received in the faceplate compartment and viewed through the outer crystal.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

FIG. 1 is a top plan view of a watch in accordance with the present invention showing the removable rim assembly and face partially removed;

FIG. 2 is a side elevational view in partial cross-section of the watch shown in FIG. 1;

FIGS. 13A, 13B and 13C are top plan view of the horologe of FIG. 9 showing the sequence of movements as the face is inserted into the body;

DETAILED DESCRIPTION OF THE PREFERRED EMBODIMENTS

Figure 3:
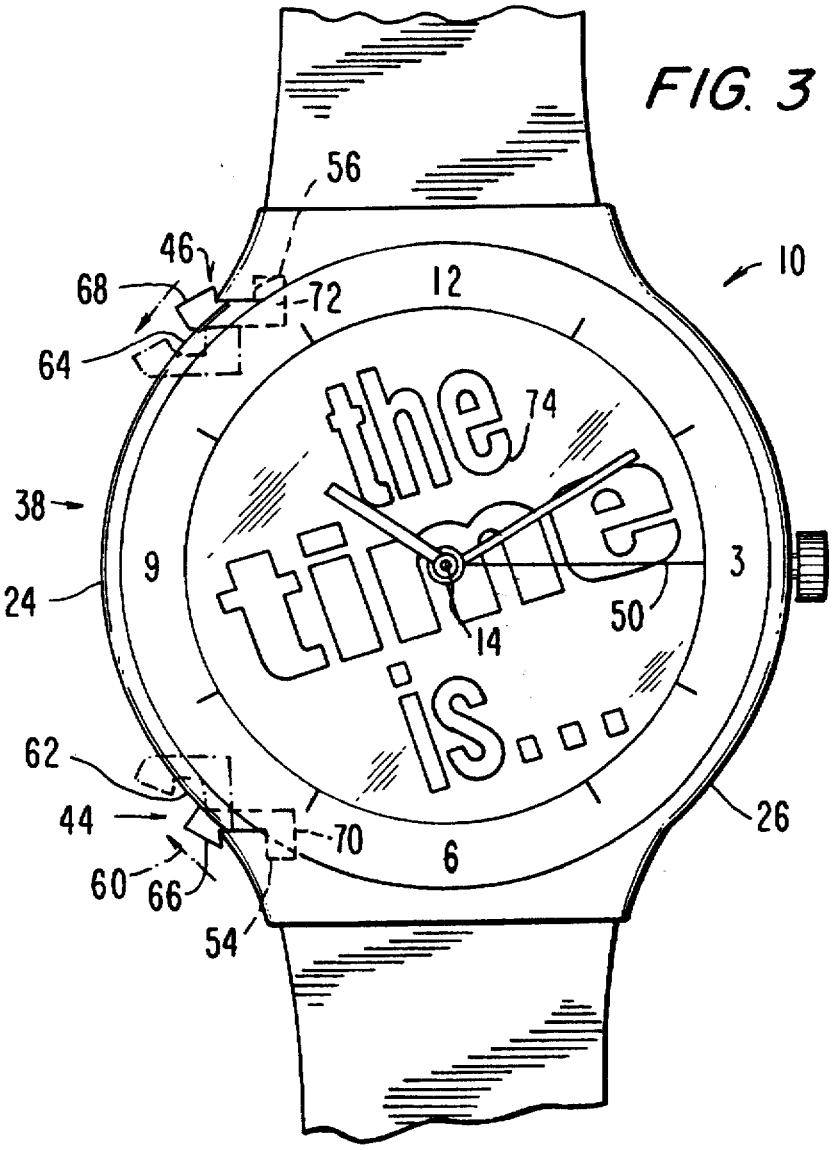
FIG. 3 is a top plan view of a watch in FIG. 1 showing the removable rim assembly and face completely inserted into the body.
Figure 4:
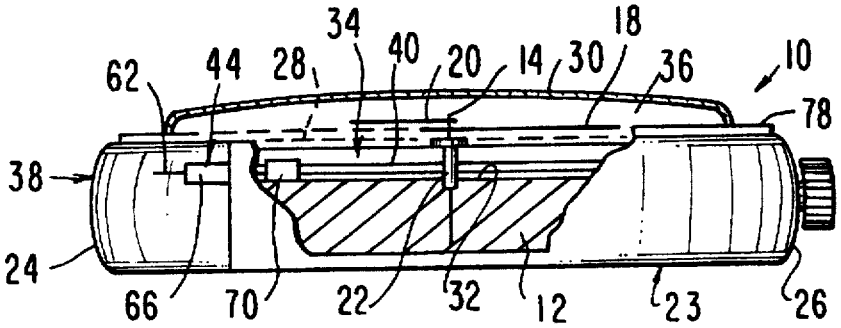
FIG. 4 is a side elevational view in partial cross-section of the watch shown in FIG. 3.
Figure 5:
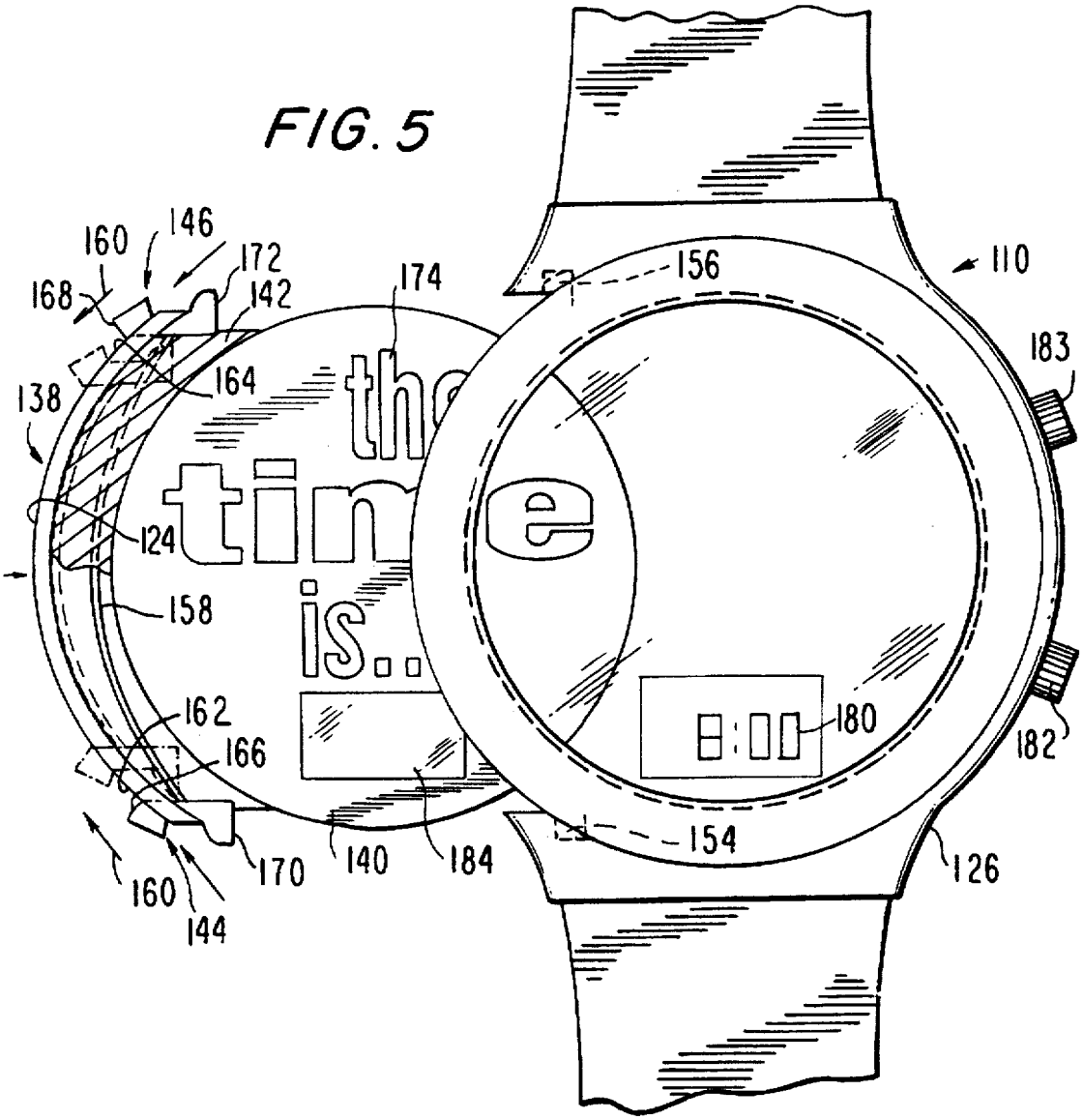
FIG. 5 is a top plan view of a watch in accordance with a second embodiment of the invention showing the removable rim assembly and face partially removed from the body.
Figure 6:
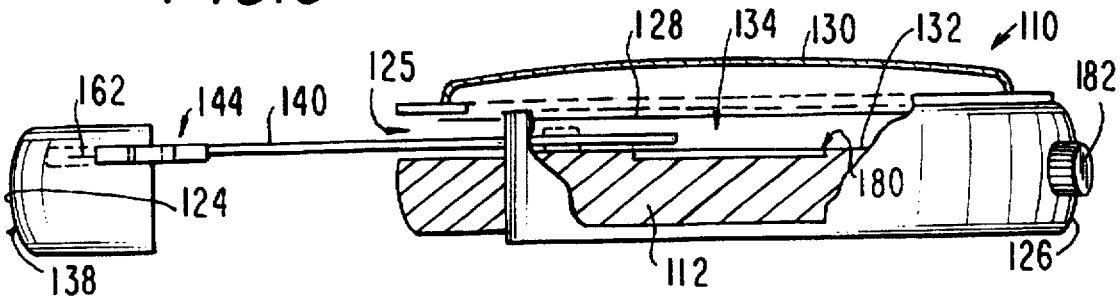
FIG. 6 is a side elevational view in partial cross-section of the watch shown in FIG. 5.
Figure 7:
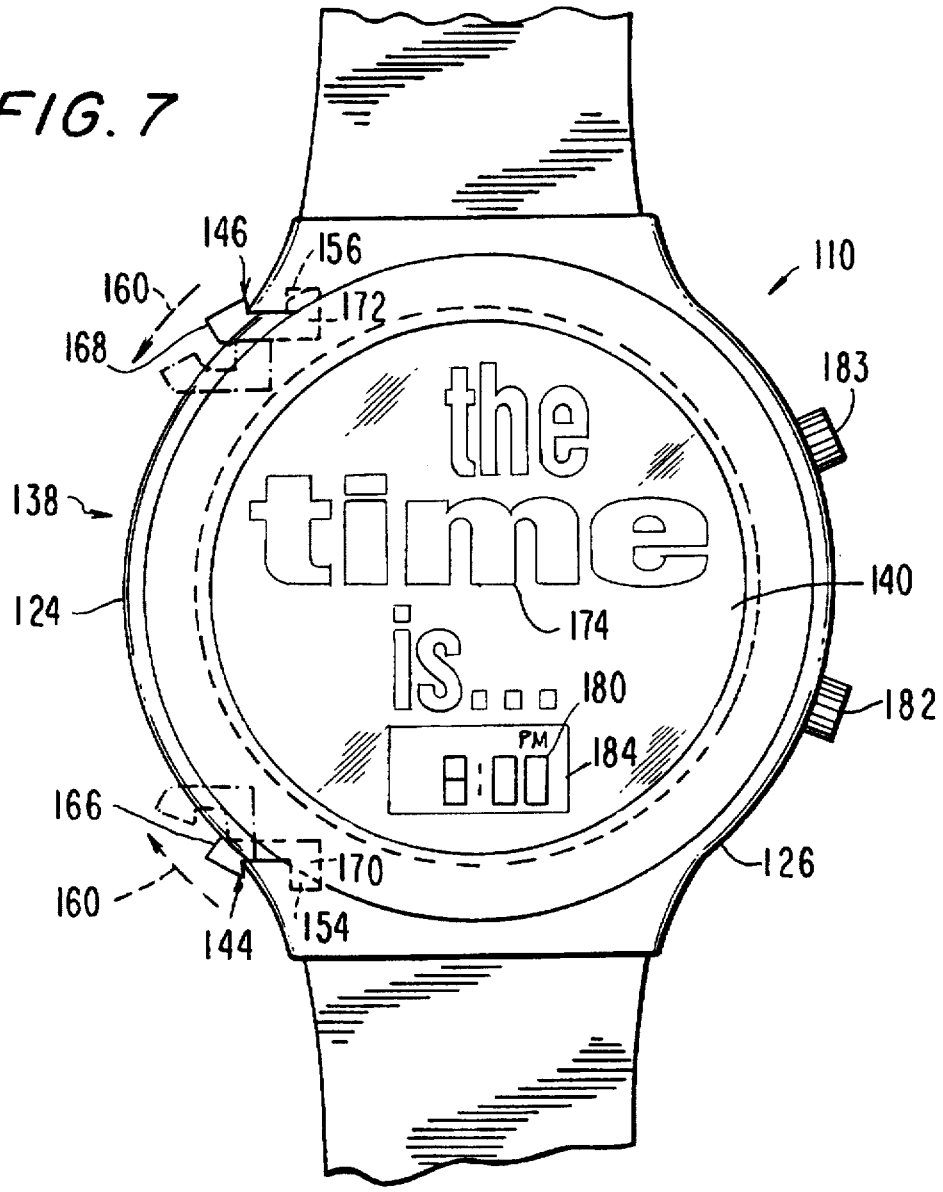
FIG. 7 is a top plan view of the watch of FIG. 5 showing the rim assembly and face completely inserted into the body.
Figure 8:
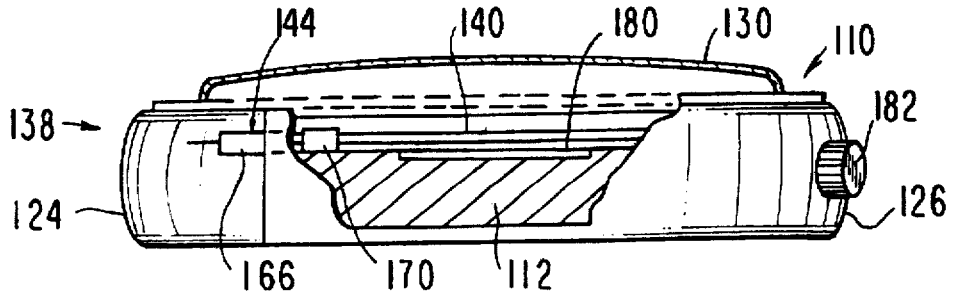
FIG. 8 is a side elevational view in partial cross-section of the watch shown in FIG. 7.
Figure 9:
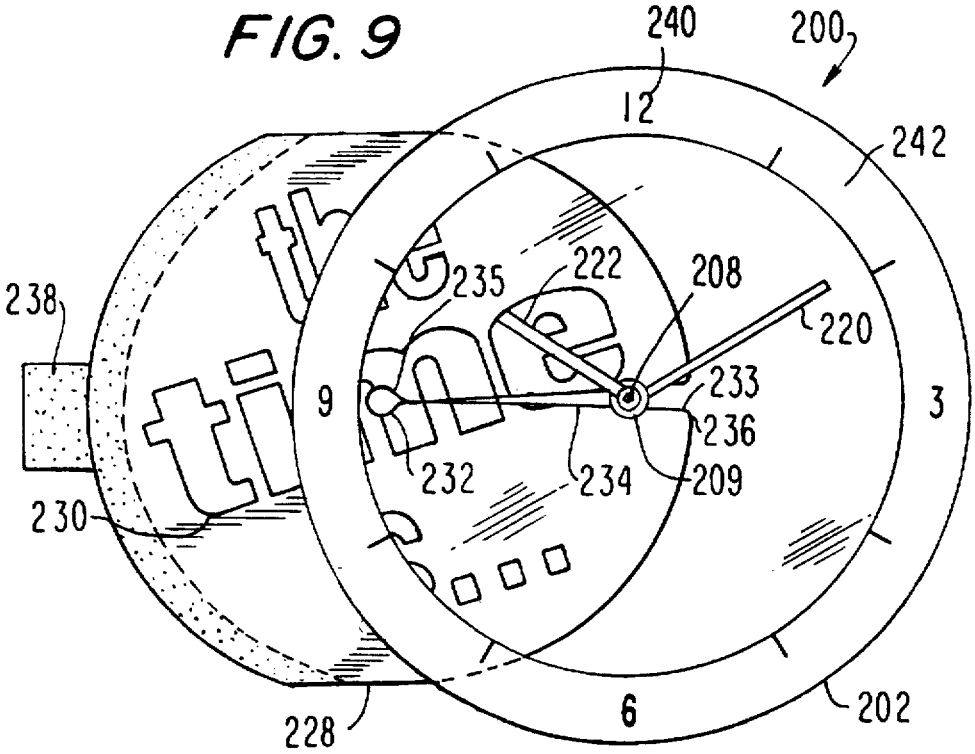
FIG. 9 is a top plan view of a clock comprising a third embodiment of the invention, showing the removable face partially removed from the body.
Figure 10:
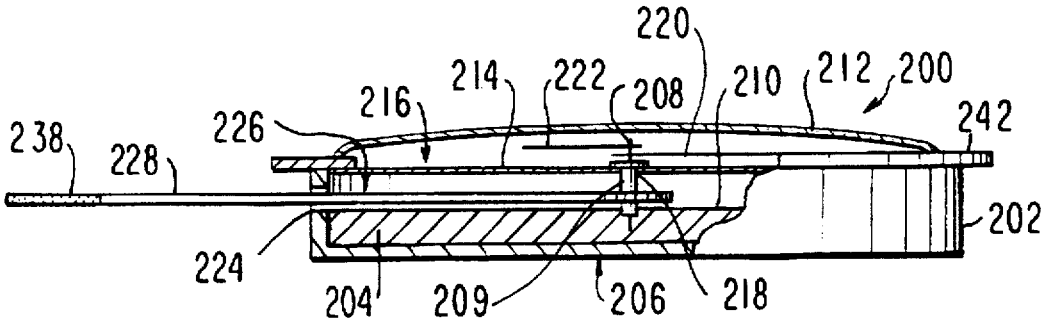
FIG. 10 is a side elevational view in partial cross-section of the clock shown in FIG. 9.
Figure 11:
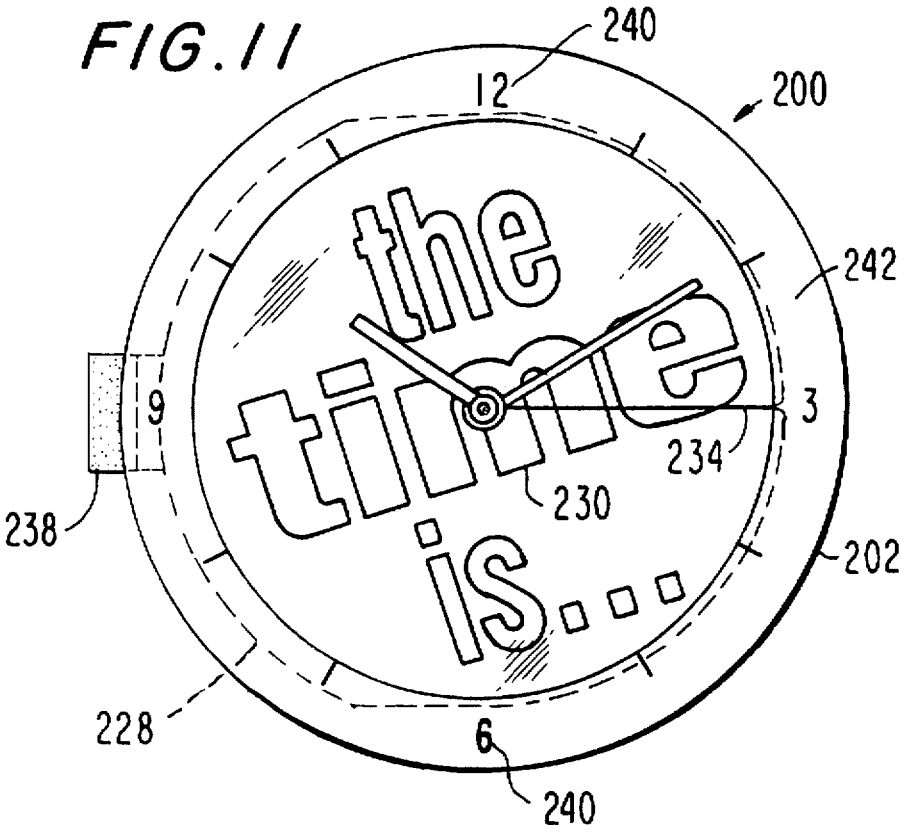
FIG. 11 is a top plan view of the clock of FIG. 9 showing the face completely inserted into the body.
Figure 12:
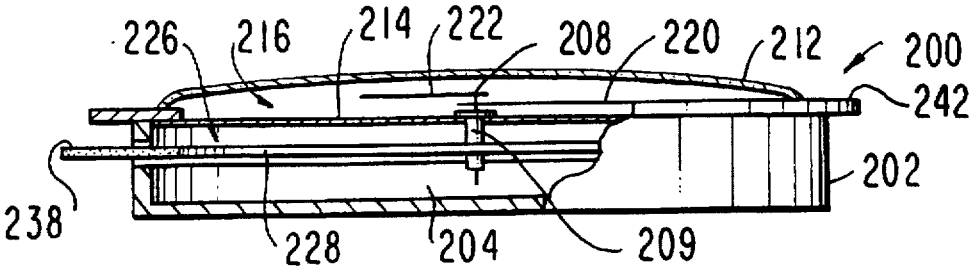
FIG. 12 is a side elevational view in partial cross-section of the clock of FIG. 11.

Referring now to the drawings, wherein like reference numerals refer to like elements, a first embodiment of a horologe in accordance with the present invention is shown in FIGS. 1–4 and designated generally by the numeral 10. Horologe 10 comprises an analog watch or timepiece mechanism 12 which is encased and sealed from the rest of the timepiece. A shaft or stem 14 that drives the minute hand 18 and the hour hand 20 extends out from the timepiece mechanism 12 perpendicular to the plane of the body. Shaft 14 can be encased in an outer protective sleeve or sheath 22 if desired. Watch mechanism 12 is surrounded by a body 23 which extends around its periphery. The body 23 comprises a removable rim portion 24 and a non-removable rim portion 26. An inner transparent cover 28 and an outer transparent crystal 30 are attached to the non-removable rim portion 26 above the outer surface 32 of the body 23. Inner transparent cover 28 is disposed below hands 18 and 20, and outer transparent crystal 30 is disposed above such hands in the manner of a conventional watch crystal. A segregated faceplate compartment 34 is formed by the outer surface 32, the non-removable rim portion 26 and the inner transparent cover 28. The non-removable rim portion 26 includes an opening 25 to the faceplate compartment 34 which is normally closed by the removable rim portion 24. An outer enclosed space 36 formed by the non-removable rim portion 26, the inner transparent cover 28 and the outer transparent crystal 30 is sealed to protect the movement of the hands 18 and 20. Sleeve 22 can be sealed to the inner transparent cover 28 to prevent dirt and moisture from entering outer enclosed space 36.

Horologe 10 further comprises a removable rim assembly 38 which includes the removable rim portion 24 and a flange 42 attached to removable rim portion 24 for attachment to a removable face 40. In embodiments of the invention, face 40 is fixed to flange 42 on removable rim assembly 38 to form a one piece unit. Removable rim assembly 38 also includes a means for engagement and attachment of the rim assembly 38 to the non-removable rim portion 26. The engagement means shown comprises two flexible resilient tabs 44 and 46 mounted at the two ends of removable rim portion 24. In one embodiment of the invention, the removable face 40 is removably attached to removable rim assembly 38. Face 40 can be removably coupled to flange 42 by any suitable means such as for example, by snaps or a pressure sensitive adhesive. Face 40 may be made of any thin, substantially flat, flexible and resilient material. Typically, face 40 is made from a plastic material such as, for example, polyester or polyethylene. Face 40 is preferably made of a resilient plastic having a thickness sufficiently thin to be flexible enough to slide around shaft 14 and sleeve 22 without interfering with the shaft 14 or sleeve 22. Face 40 is interchangeable and includes any visual design desired. In the embodiment illustrated, face 40 includes indicia 74 or printed graphic elements.

Face 40 further includes an aperture 48 in the center of the face. Aperture 48 is sufficient in size to permit shaft 14 and sleeve 22 to extend therethrough. Face 40 also includes a cut 50 defining a slit which extends radially from aperture 48 to the perimeter of face 40. Cut 50 is preferably a hairline cut, with opposing edges of the cut preferably contacting or nearly contacting each other, so that face 40 appears seamless when assembled into horologe 10. Aperture 48 may be round, but is preferably curved or teardrop shaped adjacent cut 50. The outer end 52 of cut 50 is preferably curved for ease of use when sliding around shaft 14 and sleeve 22.

In the embodiment shown, the bezel 78 of body 23 includes indicia 80 in the form of Arabic numeral for complementing the hands 18, 20 of the horologe 10. In this manner, the function of the horologe and the ability to determine is not disrupted by the removal of the face 40. In alternative embodiments, the numerals or symbols for indicating the time may be provided on the removable face 40. In further embodiments, bezel 78 does not include any numbers or indicia for indicating the time although some means can be provided to indicate the correct orientation of the horologe with respect to the user.

Referring to FIGS. 1 and 2, horologe 10 of the present invention is used by first selecting a removable face 40 which the user desires to display and attaching it to flange 42 on removable rim assembly 38 by the attachment means, with cut 50 in face 40 extending radially in the direction opposite rim assembly 38. Face 40 is then inserted into faceplate compartment 34 and pushed inward until the end 52 of cut 50 engages shaft 14 and sleeve 22. The flexible material of face 40 bends as it passes on either side of shaft 14. The resilient properties of the material of face 40 allow face 40 to immediately flatten and return to its original substantially flat shape when cut 50 passes beyond shaft 14 and sleeve 22 so that shaft 14 enters aperture 48. Cut 50 is preferably made sufficiently thin so that the opposing edges thereof contact or nearly contact each other when the face 40 is inserted into the horologe 10, so that the cut 50 is not readily noticeable to the user. In order to lock removable rim assembly 38 in horologe 10, the user simultaneously squeezes the two tabs 44 and 46 toward the center of removable rim portion 24 as the removable rim assembly 38 is inserted into the body 23 of the horologe 10.

The tabs 44, 46 can be made of a flexible, resilient material. If the tabs are not sufficiently resilient themselves, they can be connected to each other or to removable rim assembly 38 by a resilient material, such as a spring 58 which biases the tabs outwardly. Assembly 38 comprises tabs 44, 46 attached to removable rim portion 24 for movement in a locking and unlocking direction as indicated by arrows 60. Removable rim portion 24 includes apertures 62, 64 on opposite ends thereof for receiving tabs 44, 46, respectively, and allowing limited movement of the tabs with respect to the removable rim portion 24 as shown in phantom lines in FIGS. 1 and 3. Tabs 44, 46 further include actuating members 66, 68, respectively, extending outwardly from the removable rim portion 24 and hook members 70, 72, respectively, for engaging recesses 54, 56 in the non-removable rim portion 26.

The user simultaneously squeezes the tabs 44, 46 toward each other and inserts the face 40 through opening 25 into faceplate compartment 34, at which point the tabs 44 and 46 are released, and the hook members 70, 72 on the tabs engage the recesses 54, 56 in the non-removable rim portion 26. Upon complete insertion of the face 40 in faceplate compartment 34, the resilient property of face 40 allows it to appear seamless in the inserted and locked position shown in FIGS. 3 and 4. In order to change face 40 to a different face, the user squeezes the tabs 44 and 46 together and withdraws the removable rim assembly 38 and face 40 from faceplate compartment 34. Another rim assembly with a face attached thereto or another face can then be selected and attached to rim assembly 38 and the process can be repeated.

Thus, it can be seen that the horologe of the present invention has a number of advantages. For example, the horologe has a limited number of moving parts and has a sturdy design and construction. The horologe requires only a single movement to remove or insert the removable rim assembly and 38, therefore, it is quick and easy to remove or insert the desired face.

The removable rim assembly 38 and the face 40 are preferably assembled as one piece making it easy to insert and remove the assembly as a single unit, so that the face remains in a fixed position when inserted without the need for additional stops or tabs. Because the locking mechanism defined by the tabs 44, 46 is part of the removable rim and assembly 38, a single movement allows the user to insert or detach the removable rim assembly 38. Moreover, the design is ergonomically correct, and does not create undue stress on the union between the removable and non-removable portions of the rim. It is also advantageous that the operation of the horologe, including the outer enclosed space 36 formed by the inner transparent cover 28 and the outer transparent crystal 30, is independent of the removable rim portion 24 and face 40. The segregated faceplate compartment 34 for the face 40 ensures that removable and interchangeable faces will not interfere with either the mechanism or the movement of the horologe hands. In addition, the protective sheath 22 on the center shaft 14 ensures that interchangeable faces will not interfere with the rotation of the shaft. The faceplate compartment 34, closed by the removable rim portion 24, and the outer enclosed space 36 prevent dirt, dust, grime, and moisture from contaminating timepiece components. The hairline cut 50 in the face 40 creates a near-seamless image when an interchangeable face is in the inserted and locked position, giving the appearance of a timepiece with a permanent face. Finally, changing of the faces does not affect the primary function of the timepiece, namely, to tell time.

In a second embodiment of the invention, illustrated in FIGS. 5–8, horologe 110 is a digital watch or timepiece. Numerous components are substantially similar to the horologe 10 of the embodiment of FIGS. 1–4 and like elements are identified by the same reference numbers of the 100 series.

In this embodiment, digital watch or timepiece mechanism 112 has a digital display 180. In the embodiment illustrated in FIG. 5, digital display 180 is positioned toward the outer periphery of mechanism 112. In alternative embodiments, the digital display 180 may be positioned in any desired location on the outer surface 132. Watch mechanism 112 also includes a pair of actuating buttons 182, 183 for setting the mechanism 112 in the manner known for conventional digital timepieces.

The horologe 110 includes an outer transparent crystal 130 and an optional inner transparent cover 128 spaced above surface 132 to define the faceplate compartment 134. The horologe 110 further includes a non-removable rim portion 126 and a removable rim assembly 138 which includes the removable rim portion 124 with tabs 144, 146 as in the embodiment of FIGS. 1–4. The removable rim assembly 138 and tabs 144 and 146 are substantially the same as in FIGS. 1–4 and are not discussed in detail in connection with this embodiment. The non-removable rim portion 126 includes an opening or slot 125 which is normally closed by the removable rim portion 124.

Removable face 140 is removably attached to flange 142 and is dimensioned to fit easily into the faceplate compartment 134 whereby display 180 is visible when the face 140 is completely inserted. Face 140 includes a transparent window 184 (which may comprise a simple rectangular die cut opening or a layer of transparent plastic material through which the display 180 can be viewed) positioned to be superimposed over digital display 180 when assembled. Face 140 further includes the desired indicia 174 for displaying through the crystal 130. In further embodiments, removable face 140 is a transparent material which can include suitable indicia printed thereon. In this manner, the cut window opening can be eliminated.

The horologe 110 is used in the same manner as in the previous embodiment. To change the face 140, the user simultaneously squeezes the tabs 144, 146 toward the center of the removable rim portion 124 to detach the removable rim assembly 138 from the non-removable rim portion 126 and remove the face 140 from faceplate compartment 134. Face 140 is removed from the flange 142 and replaced with the desired face. The removable rim assembly 138 and desired removable face 140 are then inserted as in the previous embodiment so that the digital display 180 can be viewed through the face 140.

In a third embodiment of the invention, illustrated in FIGS. 9–13, the horologe is an analog clock or timepiece 200 having a clock mechanism 204 enclosed in a body 206 with a shaft 208 extending outwardly through outer surface 210. Attached to rim 202 is an outer transparent crystal 212 and an inner transparent cover 214 defining an outer enclosed space 216. The shaft 208 extends through an opening 218 in inner transparent cover 214 into the outer enclosed space 216. The minute hand 220 and hour hand 222 are attached to the shaft 208 in a conventional manner. An outer protective sleeve 209 surrounds shaft 208 to protect the shaft from interference when inserting the removably face 228. Preferably the sleeve 209 is sealed to the inner transparent cover 214 and outer surface 210 to prevent moisture and dirt from entering the outer enclosed space 216.

Rim 202 is provided with an opening 224 along one side thereof to provide an opening into a faceplate compartment 226 defined between the inner transparent cover 214 and outer surface 210. A removable face 228 having the desired printed graphic elements or indicia 230 is provided to fit easily in faceplate compartment 226. As in the embodiment of FIGS. 1–4, removable face 228 includes a central aperture 232 and radial slit 234 (preferably comprising a hairline cut with its opposition edges contacting or nearly contacting each other) extending from aperture 232 to the outer edge 236 of the removable face 228. The outermost corner 233 of slit 234 and the innermost corner 235 are rounded, as shown, to slide easily around shaft 208. A gripping tab 238 extends outwardly from removable face 228. Tab 238 can be integrally formed with removable face 228 or removably attached to accommodate different clock faces. Tab 238 can engage rim 202 to securely attach the removable face 228 to the body 206 in any known manner. In the embodiment shown, indicia 240, such as numbers, are provided on the bezel 242 of body 206. In further embodiments, the indicia can be on the removable face 228. As in the previous embodiment, the radial slit 234 is very thin and the removable face 228 is sufficiently flexible to slide around the shaft 208 without interfering with the shaft 208 or damaging the removable face 228. The resilience of the removable face 228 allows the face to return to its normal position when the shaft is positioned in the central aperture 232 of removable face 228 with slit 234 being nearly undetectable to the user.

In the embodiment illustrated, the opening 224 in rim 202 is slightly larger than removable face 228. In further embodiments, the rim 202 can include a removable closure or removable rim assembly cooperating with opening 224 to completely close the opening, and, for example, to prevent dirt or dust from entering the faceplate compartment 226. The removable face 228 can be coupled to the closure by any suitable means, such as that used in the embodiment of FIGS. 1–4.

As shown in the sequence of FIGS. 13A–13C, the removable face 228 bends as it passses on either side of the shaft 208 from the position shown in FIG. 13A to the position of FIG. 13C where the removable face 228 immediately flattens and returns to its normal substantially flat shape.

Figure 14:
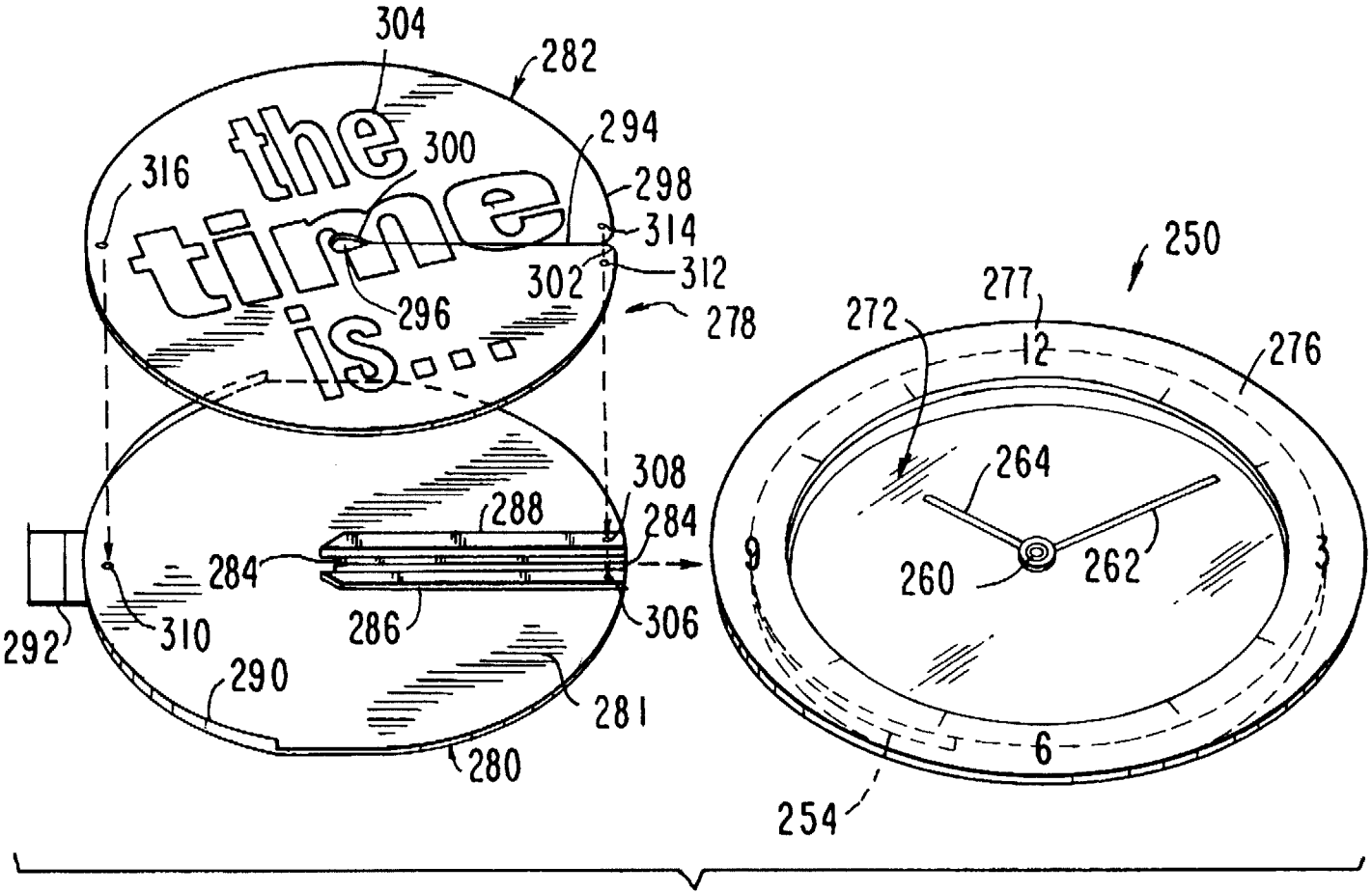
FIG. 14 is a perspective view of a clock in a further embodiment of the invention showing a tray for receiving a removable face.
Figure 15:
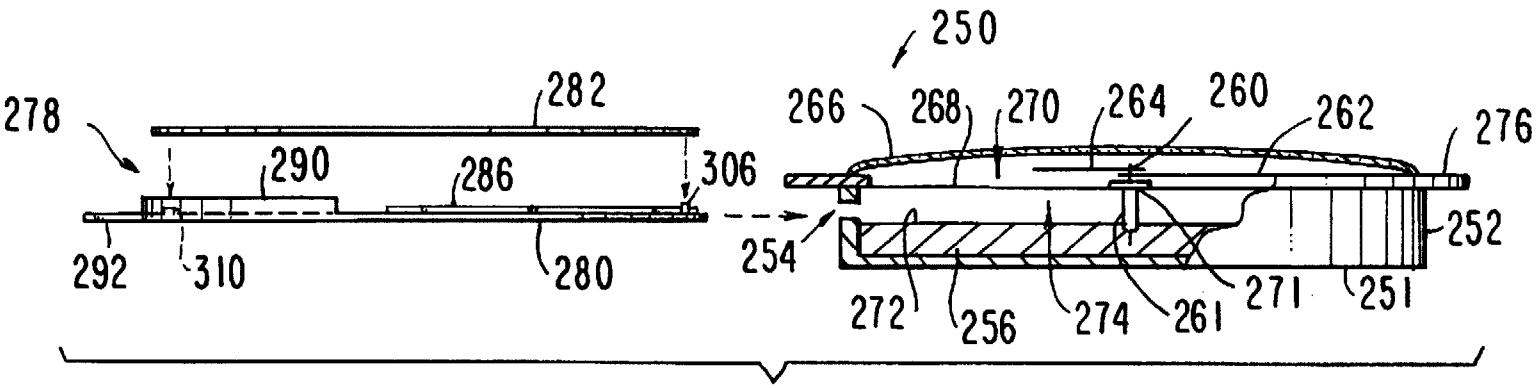
FIG. 15 is a side elevational view of the clock of FIG. 14 showing the clock body in partial cross-section.

In a further embodiment illustrated in FIGS. 14 and 15, the horologe is an analog clock 250 having a body 251 comprising a rim 252 with an opening 254 in the side thereof. The clock 250 includes a horologe mechanism 256 having a shaft 260 with an outer protective sleeve 261 and a pair of hands 262, 264 attached to shaft 260. An outer transparent crystal 266 and an inner transparent cover 268 are attached to rim 252 to form an outer enclosed space 270. Shaft 260 extends through an aperture 271 in inner transparent cover 268 so that hands 262, 264 are contained in outer enclosed space 270. Rim 252 outer surface 272 of body 251 and the inner transparent cover 268, spaced above the outer surface 272, define a faceplate compartment 274. A bezel 276 surrounds the clock 250 and can include suitable indicia such as numbers 277.

A removable faceplate assembly 278 includes a tray 280 and a removable face 282. The tray 280 has a flat bottom surface 281 with an elongated slot 284 extending radially outward from the center to the outer edge of tray 280. A pair of raised inserts 286, 288 are positioned on each side of slot 284. A lip 290 is also provided on the tray 280 opposite slot 284. A tab 292 for gripping tray 280 is attached to tray 280 adjacent lip 290.

Face 282 is dimensioned to complement tray 280 and includes an elongated slit 294 extending radially outward from a center aperture 296 toward an outer edge 298 and is made of a flexible and resilient material. As in the previous embodiment, slit 294 has rounded inner corners 300 and rounded outer corners 302. Slit 294 is a hairline cut to be undetectable or nearly undetectable by the user. Indicia or printed graphic material 304 is provided on removable face 282.

The tray 280 includes pins 306, 308 on each raised insert 286, 288 adjacent the outer edge of tray 280 and a pin 310 on the side opposite slot 284. Face 282 includes an aperture 312, 314 on each side of slit 294 adjacent the outer edge and an aperture 316 opposite the slit 294. Apertures 312, 314 and 316 of face 282 snap onto pins 306, 308 and 310 of tray 280 to secure face 282 to tray 280.

In use, the desired face 282 is attached to tray 280 by snapping face 282 to pins 306, 308 and 310. Tray 280 is inserted into opening 254 in rim 252. Slit 284 of face 282 bends as it passes on either side of shaft 260 and sleeve 261 as in previous embodiments, until shaft 260 and sleeve 261 enter aperture 296. When shaft 260 and sleeve 261 are in aperture 296 lip 290 will align with rim 252. In preferred embodiments, lip 290 is dimensioned to substantially close and seal opening 254 to prevent dust from entering the faceplate compartment 274. The face 282 can be changed by removing the faceplate assembly 278 from the horologe 250 and unsnapping the face 282 from the tray 280. The desired face 282 is attached to the tray and the faceplate assembly 278 is inserted into the opening 254.

While advantageous embodiments have been disclosed to illustrate the invention, it will be understood by those skilled in the art that various modifications and changes can be made therein without departing from the scope of the invention as defined in the following claims.

What is claimed is:

1. A horologe comprising:

a body comprising a horological mechanism and having a substantially flat outer surface;

a shaft extending in a perpendicular direction from the outer surface and being operatively connected to said horological mechanism;

at least one hand attached to the shaft and extending in a direction parallel to the outer surface;

a rim extending around the periphery of the body, said rim having a removable rim assembly and a non-removable rim portion;

an inner transparent cover and an outer transparent crystal attached to the non-removable rim portion above the outer surface and defining a closed space, said crystal being disposed above the hand and the inner cover being disposed below the hand, said inner cover being spaced from said outer surface of said body to define a faceplate compartment;

a thin, substantially flat face removably received in said faceplate compartment, wherein the face is made of flexible, resilient material having a central aperture of sufficient size to permit the shaft to extend therethrough, and having a hairline cut extending radially from the central aperture to a perimeter of the face;

said removable rim assembly comprising said face attached thereto, and two flexible, resilient tabs coupled to opposite ends of the removable rim assembly for engagement with and attaching to the non-removable rim portion.

2. The horologe of claim 1, wherein the horologe is a watch.

3. The horologe of claim 1, wherein the horologe is a clock.

4. The horologe of claim 1, further comprising a spring, wherein each of said tabs are attached to opposite ends of said spring and being biased outwardly from said removable rim assembly.

5. The horologe of claim 1, wherein said hairline terminates in rounded corners adjacent a peripheral edge of said face and said central aperture.

6. The horologe of claim 1, wherein said face includes printed indicia.

7. The horologe of claim 1, wherein said central aperture of said face is tapered.

8. A horologe comprising:

a body enclosing a horological mechanism and having a substantially flat outer surface;

an outer transparent crystal attached to said body and being spaced from said outer surface for defining a faceplate compartment;

said body including a rim portion having an opening for accessing said faceplate compartment, said body having a pair of recesses adjacent said opening;

a removable rim assembly having a pair of coupling tabs at opposite ends thereof for coupling with said recesses of said body and substantially closing said opening;

a removable face attached to said removable rim assembly and being dimensioned to be received in said faceplate compartment and viewed through said outer crystal.

9. The horologe of claim 8, wherein said horological device includes a digital display on said outer surface, and said face includes at least one aperture superimposed on said digital display.

10. The horologe of claim 8, wherein said removable face is made from a thin, flexible material.

11. The horologe of claim 8, wherein said face is transparent and said horological mechanism includes a time display visible through said face.

12. The horologe of claim 8, wherein said horological mechanism includes a time display, and said face includes an aperture for viewing said display.

13. The horologe of claim 8, further comprising an inner transparent cover coupled to said body and spaced from said crystal to define an outer enclosed space, said inner cover further having a central aperture; and said horological mechanism further comprising a shaft operatively coupled to said mechanism and extending outwardly from said outer surface and through said aperture in said inner cover, and at least one hand coupled to said shaft and positioned in said outer enclosed space.

14. The horologe of claim 13, wherein said face includes a central aperture dimensioned to receive said shaft, and a slit extending from said aperture radially outward to a peripheral edge of said face.

15. The horologe of claim 14, wherein said slit terminates in rounded corners adjacent said aperture and said peripheral edge, and wherein opposing edges of said slit contact each other or are closely spaced when the shaft is positioned in said central aperture.

16. The horologe of claim 8, further comprising a spring disposed in said removable rim assembly, said coupling tabs being attached to opposite ends of said spring and being biased outwardly with respect to said removable rim assembly.

17. The horologe of claim 8, wherein said removable rim assembly includes a pair of apertures at opposite ends thereof, and said coupling tabs are mounted in said apertures for limited reciprocal movement with respect to said rim assembly.

18. The horologe of claim 17, wherein said coupling tabs have an actuating portion extending outwardly from said removable rim assembly, and a hook portion extending outwardly from said removable rim portion for coupling with said recesses in said body portion.

19. The horologe of claim 15, wherein said removable face is removably attached to said removable rim assembly.

20. The horologe of claim 14, wherein said central aperture of said face is tapered.

21. A horologe comprising:

a body having a horological mechanism and having a substantially flat outer surface;

a shaft extending in a perpendicular direction from the outer surface and being operatively connected to said horological mechanism;

at least one hand attached to the shaft and extending in a direction parallel to the outer surface;

a rim extending around the periphery of said body;

an inner transparent cover and an outer transparent crystal attached to the rim above the outer surface and defining a closed space, said crystal being disposed above the hand and the inner cover being disposed below the hand, said inner cover being spaced from said outer surface of said body to define a faceplate compartment;

said rim having an opening for accessing the faceplate compartment;

a removable face removably received in said faceplate compartment, and having a central tapered aperture for receiving said shaft and a hairline cut extending radially from said central aperture to a peripheral edge of said face, wherein opposing surfaces of said cut contact each other; and a tab coupled to said face extending away from said opening.

22. The horologe of claim 21, wherein said tab is fixed to said face.

23. The horologe of claim 21, wherein said body includes a planar surface surrounding said crystal, said planar surface including indicia complementing said at least one hand of said horological mechanism.

24. The horologe of claim 21, wherein said face is removably coupled to said tab.

25. The horologe of claim 21, further comprising a tray having a slot extending radially from a center to an outer edge thereof for receiving said shaft, and said removable face being removably attached to said tray so that said hairline cut is juxtaposed directly over said slot of said tray.

26. The horologe of claim 25, wherein said tray includes a lip on an edge opposite said slot for mating with said opening in said body to close said opening.

27. The horologe of claim 25, wherein said tray includes at least one pin extending upwardly from a surface of said tray, and said face includes at least one aperture for attachment to said pin.

28. The horologe of claim 25, wherein said tray further includes a raised portion adjacent said slot for supporting said face.

* * * * *